US009248671B2

(12) United States Patent
Nagahara

(10) Patent No.: US 9,248,671 B2
(45) Date of Patent: Feb. 2, 2016

(54) LABEL PRODUCTION APPARATUS AND LABEL PRODUCTION METHOD

(71) Applicant: SEIKO EPSON CORPORATION, Tokyo (JP)

(72) Inventor: Atsushi Nagahara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/211,015

(22) Filed: Mar. 14, 2014

(65) Prior Publication Data

US 2014/0292841 A1 Oct. 2, 2014

(30) Foreign Application Priority Data

Mar. 28, 2013 (JP) ..... 2013-068289

(51) Int. Cl.

| | |
|---|---|
| ***B41J 29/393*** | (2006.01) |
| ***B41J 11/66*** | (2006.01) |
| ***B31D 1/02*** | (2006.01) |
| ***B41J 3/407*** | (2006.01) |
| *B41J 11/70* | (2006.01) |

(52) U.S. Cl.

CPC ..... *B41J 11/663* (2013.01); *B31D 1/021* (2013.01); *B31D 1/026* (2013.01); *B31D 1/027* (2013.01); *B41J 3/4075* (2013.01); *B41J 11/703* (2013.01)

(58) Field of Classification Search

CPC ..... B41J 11/663; B41J 3/4075; B31D 1/026

See application file for complete search history.

(56) References Cited

U.S. PATENT DOCUMENTS

| | | | | |
|---|---|---|---|---|
| 7,959,251 | B2 * | 6/2011 | Furukawa | 347/19 |
| 2011/0061802 | A1 * | 3/2011 | Raming | 156/256 |

FOREIGN PATENT DOCUMENTS

| | | |
|---|---|---|
| JP | 2010-149333 | 7/2010 |

* cited by examiner

*Primary Examiner* — Julian Huffman

(74) *Attorney, Agent, or Firm* — Workman Nydegger

(57) ABSTRACT

A label production apparatus includes: a printing unit configured to print a label image on a first base material included in a print target medium that has the first base material, a second base material, and an adhesive layer interposed between the first base material and the second base material while using image data for generation of the label image; a test unit configured to test the label image printed on the print target medium; a memory unit configured to store layout information that specifies image arrangement positions when a plurality of label images are arranged on the print target medium; and a post-process unit that is configured to cut a portion of the first base material where the label image has been formed, and generates such a cut-line based on the layout information, if a print defect is detected by the test unit, that avoids cutting of the label image in which the print defect is detected among the plurality of label images so as to cut the first base material using the generated cut-line.

6 Claims, 10 Drawing Sheets

LABEL PRODUCTION APPARATUS AND LABEL PRODUCTION METHOD

BACKGROUND

1. Technical Field

The present invention relates to label production apparatuses and label production methods.

2. Related Art

For Example, label production apparatuses configured to form images such as pictures, figures, symbols (characters), bar codes, and so on (hereinafter, also referred to as "label images") on a print target medium in which a mount, an adhesive layer, and a base material are laminated in sequence are well known. Such a label production apparatus includes a printing unit for printing label images on the base material and a post-process unit for cutting a portion of the base material (and adhesive layer) where the label images have been printed. After the cutting, an unnecessary portion, that is, a portion other than the label image is separated from the mount (hereinafter, this separation is also called "unused portion removal").

Such a label production apparatus is proposed that includes a test unit for testing label images having been printed and cuts only non-defective label images so that defectively printed label images are separated from the mount along with the unnecessary portion at a time of unused portion removal (for example, see JP-A-2010-149333).

However, a plurality of label images are arranged (attached) and printed on a print target medium in some case. In such case, in the proposed label production apparatus, there is a risk that the plurality of label images are separated without being cut even though only a single label image is defectively printed. This poses a risk that the productivity of label images is lowered.

SUMMARY

An advantage of some aspects of the invention is to enhance the productivity of label images.

A label production apparatus according to an aspect of the invention includes: a printing unit configured to print a label image on a first base material included in a print target medium that has the first base material, a second base material, and an adhesive layer interposed between the first base material and the second base material while using image data for generation of the label image; a test unit configured to test the label image printed on the print target medium; a memory unit configured to store layout information that specifies image arrangement positions when a plurality of the label images are arranged on the print target medium; and a post-process unit that is configured to cut a portion of the first base material where the label image has been formed, and generates such a cut-line based on the layout information, if a print defect is detected by the test unit, that avoids cutting of the label image in which the print defect is detected among the plurality of label images so as to cut the first base material using the generated cut-line.

Other aspects of the invention will be clarified hereinafter through descriptions of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Outline

Figure 1:
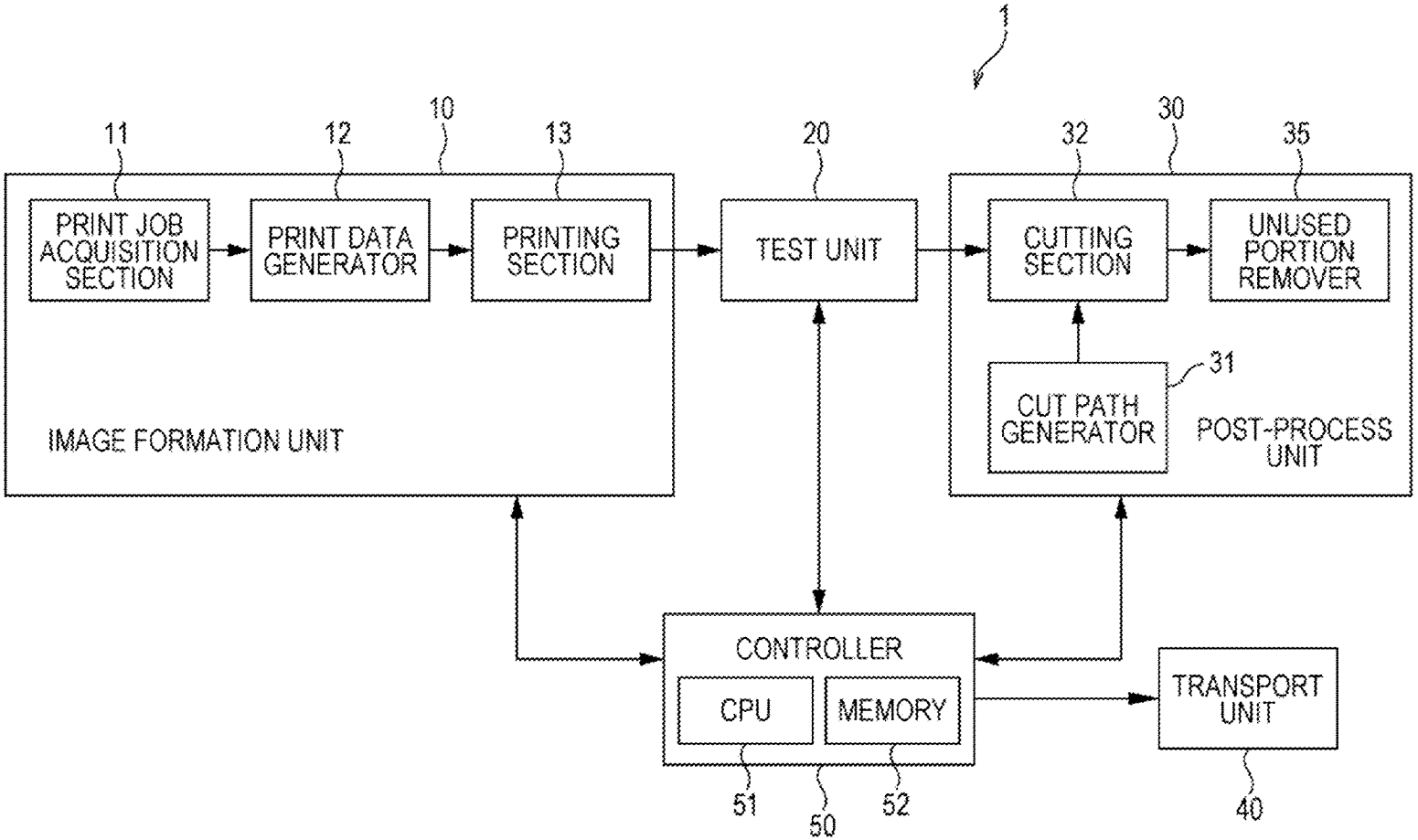
FIG. 1 is a block diagram illustrating a configuration of a label production apparatus.

At least the following will be clarified through descriptions of this specification and the drawings.

A label production apparatus including the following constituent elements will be clarified: that is, a printing unit configured to print a label image on a first base material included in a print target medium that has the first base material, a second base material, and an adhesive layer interposed between the first base material and the second base material while using image data for generation of the label image; a test unit configured to test the label image printed on the print target medium; a memory unit configured to store layout information that specifies image arrangement positions when a plurality of the label images are arranged on the print target medium; and a post-process unit that is configured to cut a portion of the first base material where the label image has been formed, and generates such a cut-line based on the layout information, if a print defect is detected by the test unit, that avoids cutting of the label image in which the print defect is detected among the plurality of label images so as to cut the first base material using the generated cut-line.

According to this label production apparatus, also in the case where printing is performed attaching a plurality of label images on a medium, only a label image that has a print defect can be prevented from being cut. Accordingly, since it is possible to separate defective label images from a mount with certainty among the plurality of label images at the time of unused portion removal, the productivity of label images can be enhanced.

In the above label production apparatus, it is preferable that the label image be so configured as to include a plurality of partial images and that a certain label image be determined to be a defective print image if a print defect is detected by the test unit in at least one of the plurality of partial images of the certain label image.

According to this label production apparatus, even in the case where only part of a plurality of partial images of a label image is defectively printed, it is possible to prevent the rest of the partial images thereof from remaining. This makes it possible easily to paste a non-defective label image.

In the above label production apparatus, it is preferable that the layout information be used together with the image data when a plurality of the label images are printed in the printing unit.

According to this label production apparatus, since a plurality of label images are arranged using the layout information, it is possible to determine the respective arrangement positions of the label images with high precision.

In the above label production apparatus, it is preferable that the layout information be calculated in accordance with a detection result of differences among the plurality of label images detected by the test unit.

According to this label production apparatus, layout information can be obtained from images printed on a print target medium. This makes it possible to automatically obtain the layout information.

A label production method including the following processes will be clarified: that is, the method includes printing a label image on a first base material included in a print target medium that has the first base material, a second base material, and an adhesive layer interposed between the first base material and the second base material while using image data for generation of the label image; testing the label image printed on the print target medium; storing layout information that specifies image arrangement positions when a plurality of the label images are arranged on the print target medium; and post-processing that is configured to cut a portion of the first base material where the label image has been formed, and generates such a cut-line based on the layout information, if a print defect is detected in the testing, that avoids cutting of the label image in which the print defect is detected among the plurality of label images so as to cut the first base material using the generated cut-line.

2. Embodiment

An embodiment of the invention is given below while exemplifying a label production apparatus (hereinafter, referred to as "label production apparatus 1") configured to print images using an ink jet technique.

Figure 2:
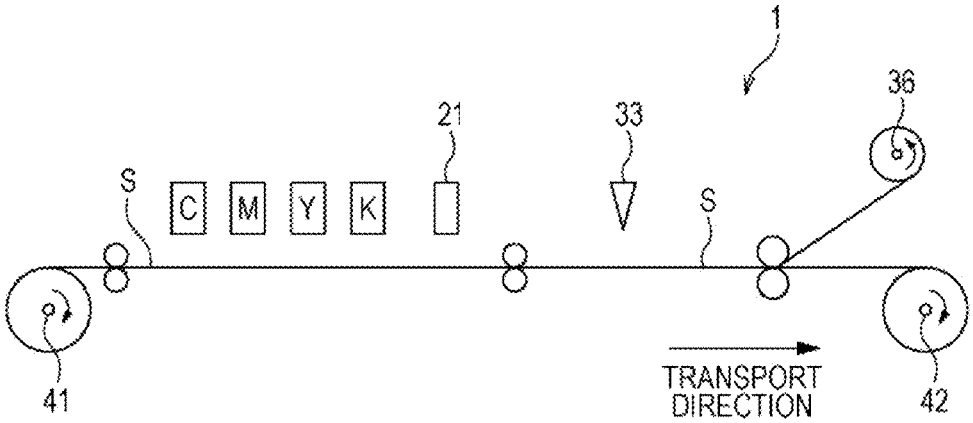
FIG. 2 is a diagram illustrating a schematic configuration of the label production apparatus.

FIG. 1 is a block diagram illustrating a configuration of the label production apparatus 1. As shown in FIG. 1, the label production apparatus 1 includes an image formation unit 10, a test unit 20 (which corresponds to the aforementioned test unit), a post-process unit 30 (which corresponds to the aforementioned post-process unit), a transport unit 40, and a controller 50. FIG. 2 shows a schematic configuration of the label production apparatus 1.

Figure 3:
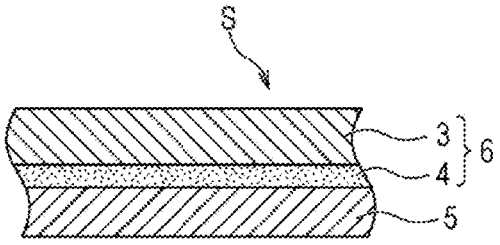
FIG. 3 is a cross-sectional view illustrating a configuration of roll paper according to an embodiment of the invention.

In this embodiment, paper that is wound in roll form (hereinafter, referred to as "roll paper S" (continuous paper)) is used as an example of a medium (which corresponds to the print target medium) on which images are printed. FIG. 3 is a cross-sectional view illustrating a configuration of the roll paper S of this embodiment. As shown in FIG. 3, the roll paper S is configured of three layers including a base material 3 (which corresponds to the first base material), a mount 5 (which corresponds to the second base material), and an adhesive layer 4 interposed between the base material 3 and the mount 5. One surface of the base material 3 (surface on the opposite side to the adhesive layer 4) is a print surface on which images (label images) are printed. The base material 3 and the adhesive layer 4 constitute a seal member 6.

2.1 Image Formation Unit 10

The image formation unit 10 is a unit configured to print images (label images) on the roll paper S.

As shown in FIG. 1, the image formation unit 10 includes a print job acquisition section 11, a print data generator 12, and a printing section 13.

The print job acquisition section 11 acquires a print job from an input device (not shown). Data of an image to be printed, data for cutting, and so on are inputted as the print job.

The print data generator 12 generates print data in accordance with the print job acquired by the print job acquisition section 11.

The printing section 13 is a section that forms (prints) a label image on the roll paper S using the print data. Note that the printing section 13 of this embodiment is a line printer including a plurality of heads which are so disposed as to face the roll paper S. To be more specific, as shown in FIG. 2, the printer has four heads including a cyan ink head C for discharging cyan ink, a magenta ink head M for discharging magenta ink, a yellow ink head Y for discharging yellow ink, and a black ink head K for discharging black ink. These four heads are disposed in series at constant intervals in the order of the cyan ink head C, magenta ink head M, yellow ink head Y, and black ink head K from the upstream side in a transport direction.

A nozzle row where a plurality of nozzles through which ink is discharged are aligned in a paper width direction, is provided in each of the heads. With this, by discharging ink from each of the heads toward the roll paper S transported in the transport direction, it is possible to form a paper width's worth of dots on the roll paper S at a time. In this manner, the printing section 13 prints the label image by discharging ink from each of the heads on the roll paper S transported in the transport direction.

2.2 Test Unit 20

The test unit 20 is a unit configured to test a label image formed on the roll paper S. The test unit 20 of this embodiment has a scanner 21. As shown in FIG. 2, the scanner 21 is disposed downstream from the heads of the image formation unit 10 in the transport direction.

The scanner 21 scans the roll paper S on which printing has been performed so as to obtain color information therefrom. Through this, the scanner 21 generates a scan image obtained by scanning the label image printed on the roll paper S.

Subsequently, the test unit 20 compares the scan image generated by the scanner 21 with the original image (image data) to test whether or not the label image was normally printed (that is, whether the image is non-defective or defective).

2.3 Post-Process Unit 30

The post-process unit 30 includes a cut path generator 31, a cutting section 32, and an unused portion remover 35.

The cut path generator 31 generates a cut-line (hereinafter, also referred to as "cut path") that is used when the seal member 6 of the roll paper S is cut in the cutting section 32. In the case where the data for cutting obtained from the print job is used as is, it is unnecessary for the cut path generator 31 to generate the cut path.

The cutting section 32 is a section configured to cut the seal member 6 of the roll paper S following the cut path. The cutting section 32 in this embodiment includes a laser cutter 33 for cutting the seal member 6 by irradiating the seal member 6 with a laser beam and an eye mark sensor (not shown)

for detecting an eye mark printed on the roll paper S. The eye mark is a mark that is used to control the timing when cutting is performed by the laser cutter 33.

The unused portion remover 35 is a section that includes an unused portion winding shaft 36 and is so configured as to separate an unnecessary portion of the seal member 6 (portion other than the label image) from the mount 5 of the roll paper S. As shown in FIG. 2, the unused portion winding shaft 36 is disposed downstream from the laser cutter 33 in the transport direction at a position above a transport path and rotates in response to the transport of the roll paper S so as to separate the unnecessary portion from the roll paper S.

Figure 4:
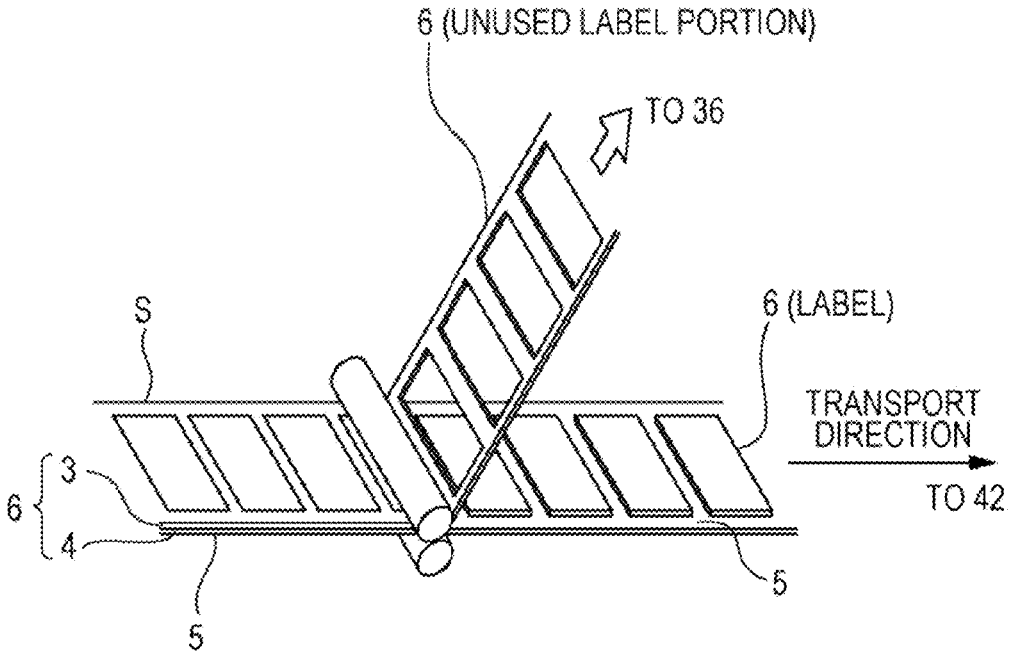
FIG. 4 is a descriptive diagram illustrating a state in which unused portion removal is being carried out.

FIG. 4 is a descriptive diagram illustrating an example of a state in which the unused portion removal is being carried out. In this example, label images each being shaped in a substantially rectangular form are printed on the roll paper S, and the perimeter of each of the label images is cut by the laser cutter 33. As shown in the drawing, an unnecessary portion of the seal member 6 (portion other than the label image) of the roll paper S having been cut is wound up (separated from the mount 5) with the unused portion winding shaft 36 so that only a portion of the seal member 6 that includes the label image is left on the mount 5.

2.4 Transport Unit 40

The transport unit 40 is a unit that includes a feed-out shaft 41 and a winding drive shaft 42 and is so configured as to transport the roll paper S in a predetermined direction (hereinafter, referred to as "transport direction").

The feed-out shaft 41 is a shaft that is so configured as to feed out the roll paper S in the transport direction and is disposed at the most upstream position in the transport direction in the transport path shown in FIG. 2.

The winding drive shaft 42 is disposed at the most downstream position in the transport direction in the transport path shown in FIG. 2, and is rotated by a motor (not shown) being driven so as to transport the roll paper S in the transport direction as well as to wind up the roll paper S on which the label images have been formed.

In addition, a plurality of rollers are disposed as part of the transport unit 40 in the transport path between the feed-out shaft 41 and the winding drive shaft 42.

2.5 Controller 50

The controller 50 is so configured as to control operation of each of the units in the label production apparatus 1, and is communicably connected with each of the units via interfaces. The controller 50 includes a CPU 51 and a memory 52. The CPU 51 executes a program (which includes various drivers' processes) that drives the respective units in the label production apparatus 1. The memory 52 stores the program to be executed by the CPU 51 and various types of data (such as image attachment information to be explained later).

The controller 50 controls each of the units in the label production apparatus 1 by making the CPU 51 execute the program stored in the memory 52. The controller 50 controls first the transport unit 40 to rotate the winding drive shaft 42 using the motor (not shown) so that the roll paper S is transported in the transport direction, during which the controller 50 controls the image formation unit 10, the test unit 20 and the post-process unit 30, respectively, so as to carry out the label production.

Figure 5:
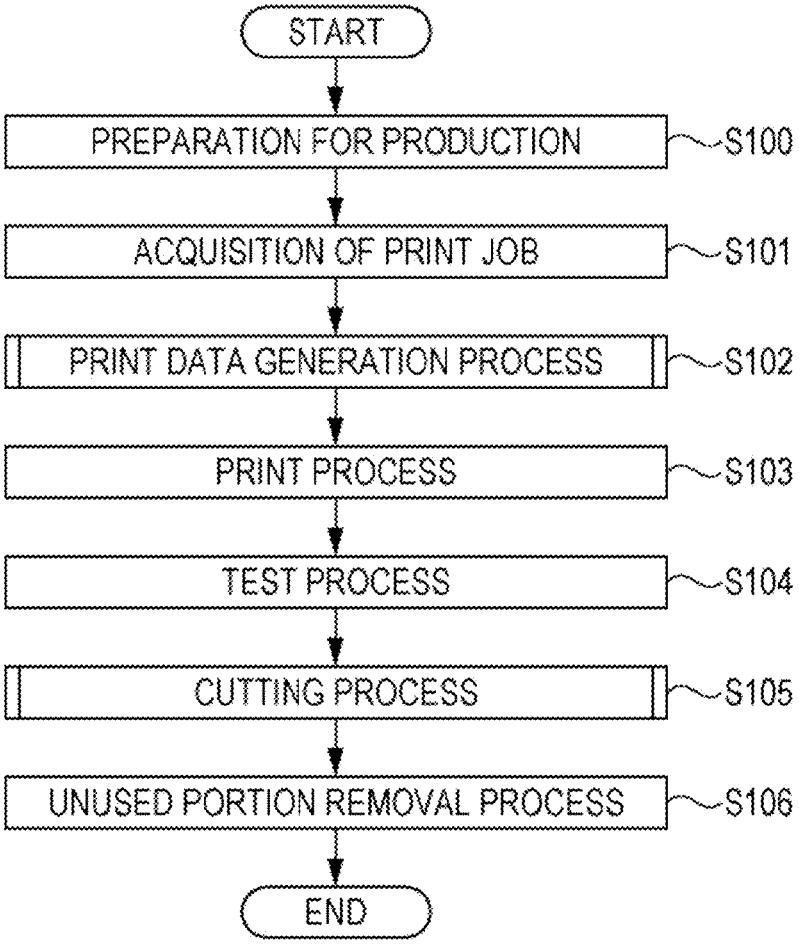
FIG. 5 is a flowchart illustrating a label production operation of the label production apparatus.

2.6 Operation of Label Production Apparatus 2.6.1 Operation in Comparative Example FIG. 5 is a flowchart illustrating a label production operation of the label production apparatus 1.

First, an operator in charge of operating the label production apparatus 1 makes preparation for the production (S100). Here, the preparation for the production includes, for example, position adjustment of the sensor (eye mark detection sensor) in the cutting section 32, adjustment of operation conditions for the unused portion removal in the unused portion remover 35, and the like.

Next, the operator inputs a print job into the label production apparatus 1 using an input device (not shown). The print job acquisition section 11 of the image formation unit 10 acquires the print job (S101). The print job acquired in S101 includes image data of an image to be actually printed and cut-line data corresponding to the image data (hereinafter, cut-line data is also referred to as "cut path data"). The cut path data may be generated in the cut path generator 31 in accordance with print data.

Figure 6:
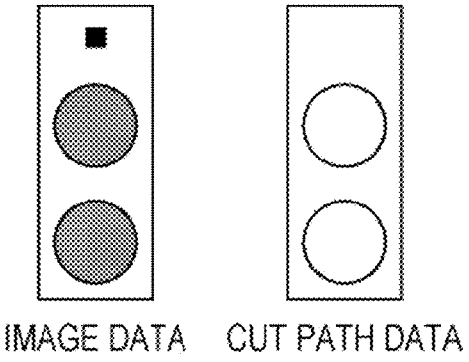
FIG. 6 is a descriptive diagram of data obtained in a comparative example.

FIG. 6 is a descriptive diagram of data obtained in the comparative example. In the comparative example, as shown in FIG. 6, image data for printing an eye mark (a mark indicated by a black square) and two circular images (label images), and cut path data for cutting the perimeter of each of the circular images are obtained. Note that these data are bitmap data.

After the acquisition of the print job, the print data generator 12 carries out a process (print data generation process) in which print data for the CMYK heads to discharge the respective color inks is generated from the image data (S102). Detailed description of the print data generation process is given below.

Figure 7:
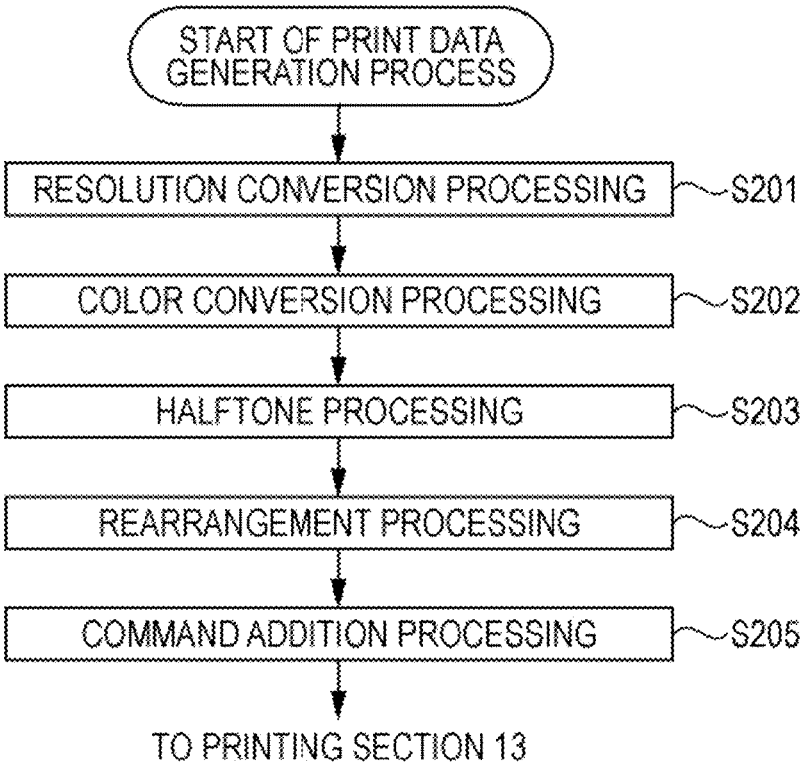
FIG. 7 is a descriptive diagram of a print data generation process.

FIG. 7 is a descriptive diagram of the print data generation process.

The print data generator 12 receives the image data from the print job acquisition section 11, converts the received image data to print data in a form that can be interpreted by the printing section 13, then outputs the print data to the printing section 13. The print data generator 12, when converting the image data to the print data, executes resolution conversion processing, color conversion processing, halftone processing, rearrangement processing, command addition processing, and so on.

The resolution conversion processing (S201) is processing in which the image data (text data, image data, and the like) is so converted as to have resolution (print resolution) with which the image is printed on paper. For example, in the case where print resolution of 720 by 720 dpi is specified, the image data is converted to bitmap-formed image data having resolution of 720 by 720 dpi. Each pixel data of the image data having experienced the resolution conversion processing is multi-tone RGB data expressed in an RGB color space (for example, 256 tones). The tone value is determined based on the RGB image data.

The color conversion processing (S202) is processing that converts the RGB data to data in a CMYK color space. The image data in the CMYK color space is data corresponding to colors of ink that the printing section 13 has. In other words, the print data generator 12 creates image data on a CMYK plane based on the RGB data.

The color conversion processing is executed based on a table in which tone values of the RGB data are related to tone values of the CMYK data. This table is called a color conversion lookup table (LUT). Note that the pixel data having experienced the color conversion processing is CMYK data of 256 tones expressed in the CMYK color space.

The halftone processing (S203) is processing that converts data of a high-tone number to data of a tone number which can be formed by the printing section 13. With this halftone processing, data indicating 256 tones is converted to one-bit data indicating two tones, two-bit data indicating four tones, or the like. One-bit pixel data or two-bit pixel data corresponds to each pixel of the image data that has experienced the halftone processing. The above pixel data is data indicating a state of dot formation at each pixel (presence/absence of dots, size of dots). In the case of the two-bit pixel data (four tones), for example, the pixel data is converted to the four levels of dot formation; that is, no dot is formed corresponding to a dot tone value "00", a small dot is formed corresponding to a dot tone value "01", a middle dot is formed corresponding to a dot tone value "10", and a large dot is formed corresponding to a dot tone value "11". Thereafter, a dot formation ratio for each dot size is determined, then the pixel data is created, making use of dithering, y correction, an error diffusion method, or the like, so that the dots are formed being dispersed by the printing section 13.

The rearrangement processing (S204) is processing in which the pixel data arranged in matrix form are rearranged in the order of data to be sent to the printing section 13 for each pixel data. For example, the pixel data are so rearranged as to correspond to the arrangement order of the nozzles of each head.

The command addition processing (S205) is processing that adds command data to the data having experienced the rearrangement processing in accordance with the print technique. As the command data, transport data indicating a transport speed of the medium can be cited, for example.

Through experiencing the above-described processings, the print data of CMYK colors is generated from the image data shown in FIG. 6. The generated print data is sent to the printing section 13.

While controlling the transport unit 40 to transport the roll paper S in the transport direction, the controller 50 controls the printing section 13 to discharge ink from the respective heads thereof onto the roll paper S using the print data (respective CMYK print data) generated in the print data generator 12. In this manner, a print process in which the image shown in FIG. 6 is printed on the roll paper S is carried out (FIG. 5: S103). By consecutively carrying out this print process, the image shown in FIG. 6 is repeatedly printed on the roll paper S.

Subsequently, the controller 50 controls the test unit 20 to carry out a test process in which the image printed by the printing section 13 is tested (S104). First, the scanner 21 is made to scan the image printed on the roll paper S when the image passes under the scanner 21. Then, the test unit 20 tests the presence/absence of defects by comparing the scanned image data (scan data) with the image data (FIG. 6). More specifically, the test unit 20 compares the scan data with the image data for each pixel. If a difference in pixel color is less than a threshold, "OK" is determined; if the difference is equal to or greater than the threshold, "NG" is determined. In this manner, it is tested whether the printed image is non-defective or defective.

Figure 8:
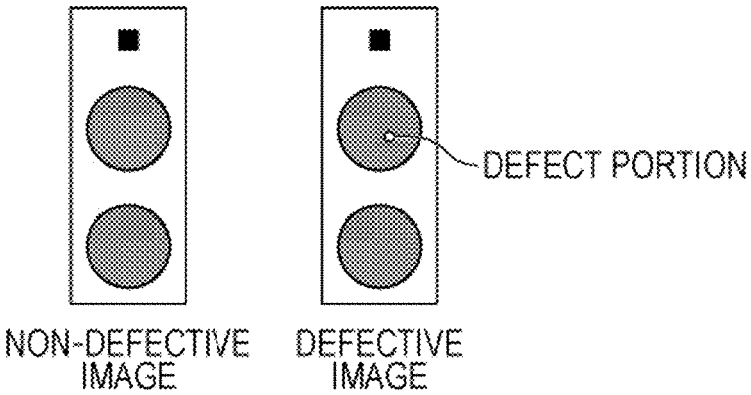
FIG. 8 is a diagram illustrating a test result.

FIG. 8 is a diagram illustrating an example of a test result. A diagram on the left in FIG. 8 shows a scan result of a non-defective image. In this diagram on the left side, because there is not any portion where a difference in color exceeds the threshold when compared with the image data (FIG. 6) for each pixel, the image is determined to be non-defective. Meanwhile, a diagram on the right in FIG. 8 shows an example of a scan result of a defective image. In this diagram on the right side, there is a portion where a dot is not formed (defect portion) due to a nozzle missing or the like. Therefore, because a portion where a difference in color exceeds the threshold is found when compared with the image data (FIG. 6) for each pixel, the image is determined to be defective.

A portion of the roll paper S that has experienced the test process in the test unit 20 is transported to the post-process unit 30. The controller 50 makes the cutting section 32 carry out a cutting process in accordance with the test result by the test unit 20 (FIG. 5: S105).

Figure 9:
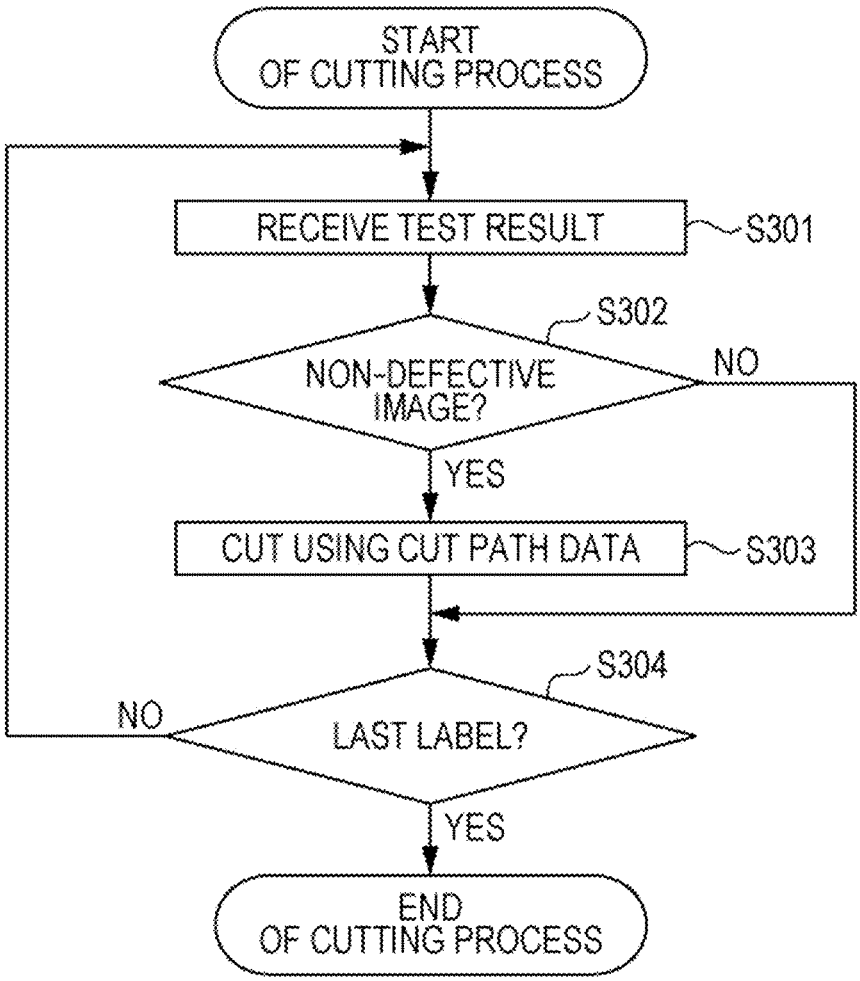
FIG. 9 is a flowchart for describing a cutting process operation of the comparative example.

FIG. 9 is a flowchart for describing a cutting process operation of the comparative example.

First, the controller 50 receives the test result from the test unit 20 (S301). If the test result indicates a non-defective image ("YES" at S302), the controller 50 makes the laser cutter 33 irradiate the seal member 6 with a laser beam using the cut path data (see FIG. 6) when the eye mark sensor (not shown) of the cutting section 32 detects the eye mark in the image of the test result. In this manner, a portion of the seal member 6 where the label image is formed is cut while following precisely the cut path data (S303). If it is determined at step S302 that there is a print defect ("NO" at S302), the cutting is not performed.

After executing step S303 or after determining "NO" at step S302, the controller 50 determines whether or not the current label is the last one. If it is determined that the current label is not the last one ("NO" at S304), the process returns to step S301 to carry out the cutting process again. If it is determined that the current label is the last one ("YES" at S304), the cutting process is ended.

A portion of the roll paper S that has experienced the cutting process is transported to the unused portion remover 35. The controller 50 makes the unused portion remover 35 carry out an unused portion removal process (FIG. 5: S106). In the unused portion removal process, the unused portion remover 35 rotates the unused portion winding shaft 36 to separate an unnecessary portion (unused portion) of the seal member 6, which is a portion other than the label, from the mount 5 (remove the unused portion) as shown in FIG. 4. In this comparative example, because a label image determined to be defective by the test result has not been cut, the defective label image is separated (removed) together with the unnecessary portion. On the other hand, a non-defective label image remains on the mount 5 and is further transported in the transport direction to be wound up in a roll by the winding drive shaft 42.

Figure 10:
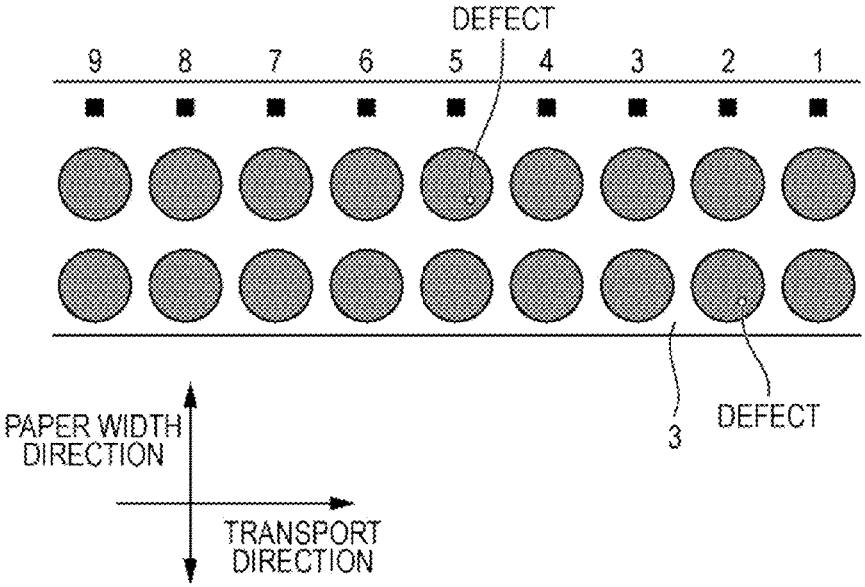
FIG. 10 is a diagram illustrating a printed result.
Figure 11:
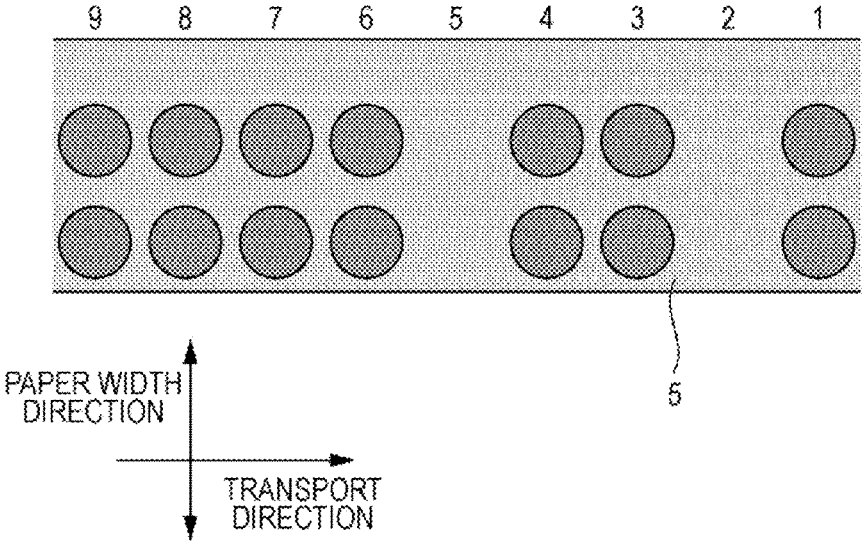
FIG. 11 is a diagram illustrating a state after operations of cutting and unused portion removal have been performed on an image shown in FIG. 10 in the comparative example.

FIG. 10 is a diagram illustrating an example of a printed result. FIG. 11 is a diagram illustrating a state after the cutting and the unused portion removal have been performed on the image shown in FIG. 10 in the comparative example. In the drawings, a number (row number) is given to each print operation (print image) of the image data shown in FIG. 6 in series from the downstream side in the transport direction. Of two images formed by a single print operation, one near the eye mark (on the upper side in the drawings) is called an image in the upper stage, while the other one far from the eye mark (on the lower side in the drawings) is called an image in the lower stage. For example, in FIG. 10, of the images of the second row, an image in the lower stage is defective. In addition, of the images of the fifth row, an image in the upper stage is defective.

In the comparative example, in the case of FIG. 10, the images of the second row and the images of the fifth row are not cut. As a result, after the unused portion removal, the images of the second and fifth rows do not remain as shown in FIG. 11. Note that the operator pastes non-defective images (labels) later to the portions from which the defective images have been separated.

As described above, in the comparative example, because non-defective label images are also removed, the productivity of label images is lowered.

2.6.2 Operation in Embodiment

Next, a label production operation in this embodiment will be described. Also in this embodiment, a flowchart of the label production is the same as that of the comparative example (FIG. 5). However, contents of the print job, the print data generation process, and the cutting process of this embodiment are different from those of the comparative example.

Figure 12:
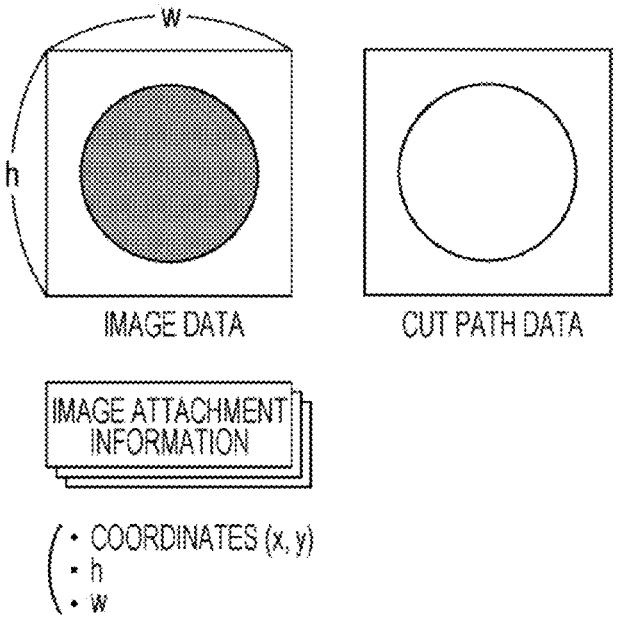
FIG. 12 is a descriptive diagram of data obtained in the embodiment.

FIG. 12 is a descriptive diagram of data obtained in this embodiment.

In this embodiment, in step S101 in which the print job is acquired, obtained are image data of a single label image as shown in FIG. 12 and image attachment information (which corresponds to the aforementioned layout information) that specifies image arrangement positions when a plurality of label images (two in this case) are arranged on the roll paper S. In addition, cut path data corresponding to the image data (data for a single image) is also obtained.

In the image attachment information, coordinates (x, y) of a position where the label image is arranged, an image width "w", an image height "h", and so on are included. As for the eye mark, the same types of data are also included therein. These various types of data and the image attachment information are stored in the memory of the controller 50.

In the print data generation process of this embodiment, the print data generator 12 generates, using the image data and the image attachment information shown in FIG. 12, image data in which the images have been attached.

Figure 13:
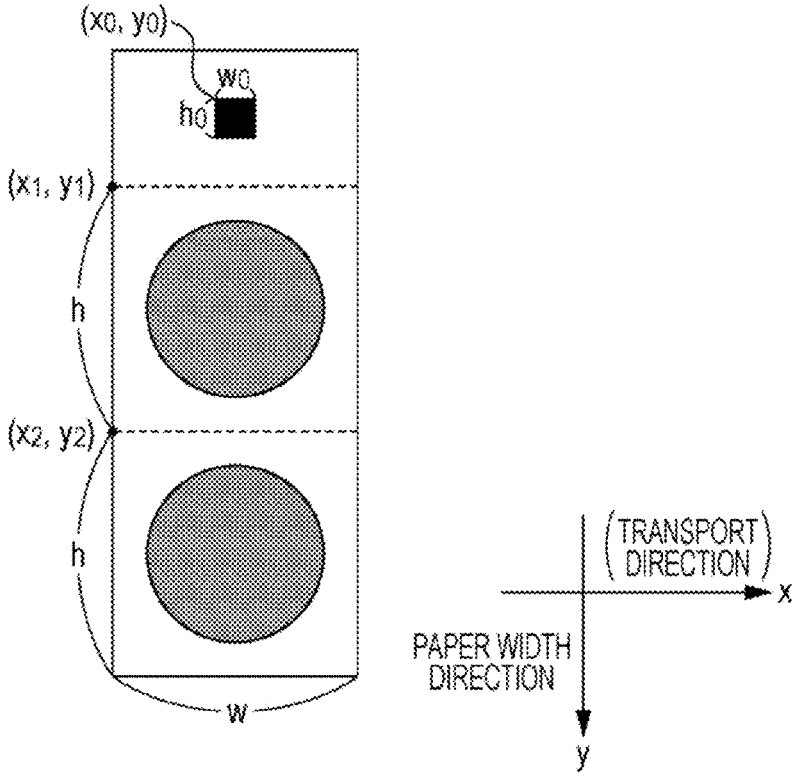
FIG. 13 is a descriptive diagram of image data in which the data shown in FIG. 12 is arranged in accordance with image attachment information.

FIG. 13 is a descriptive diagram of image data generated through arranging the data shown in FIG. 12 in accordance with the image attachment information (image data after the image attachment). In the drawing, an x-direction is the transport direction, while a y-direction is the paper width direction.

The eye mark is arranged, in accordance with the image attachment information, at a position of coordinates ($x_0$, $y_0$) having a width "$w_0$" and a height "$h_0$", as shown in FIG. 13, for example. Meanwhile, the image in the upper stage is arranged at a position of coordinates ($x_1$, $y_1$) having the width "w" and the height "h", while the image in the lower stage is arranged at a position of coordinates ($x_2$, $y_2$) having the width "w" and the height "h". Through this, the same image data as that in FIG. 6 is generated. Note that in this example, $x_2=x_1$, and $y_2=y_1+h$. After the formation of the above image data, the same print data generation process as that of the comparative example (FIG. 7) is carried out so as to generate print data of CMYK colors. In this embodiment, as described above, because image data is created using the image attachment information, it is possible to determine whether a specific position (coordinates) is included in a region of the upper stage or a region of the lower stage. Further, in this embodiment, because image attachment information, in addition to image data, is inputted and is used at the time of image attachment, image arrangement positions can be determined with high precision.

Also in this embodiment, after the generation of print data, the print process and the test process are carried out like in the comparative example.

Figure 14:
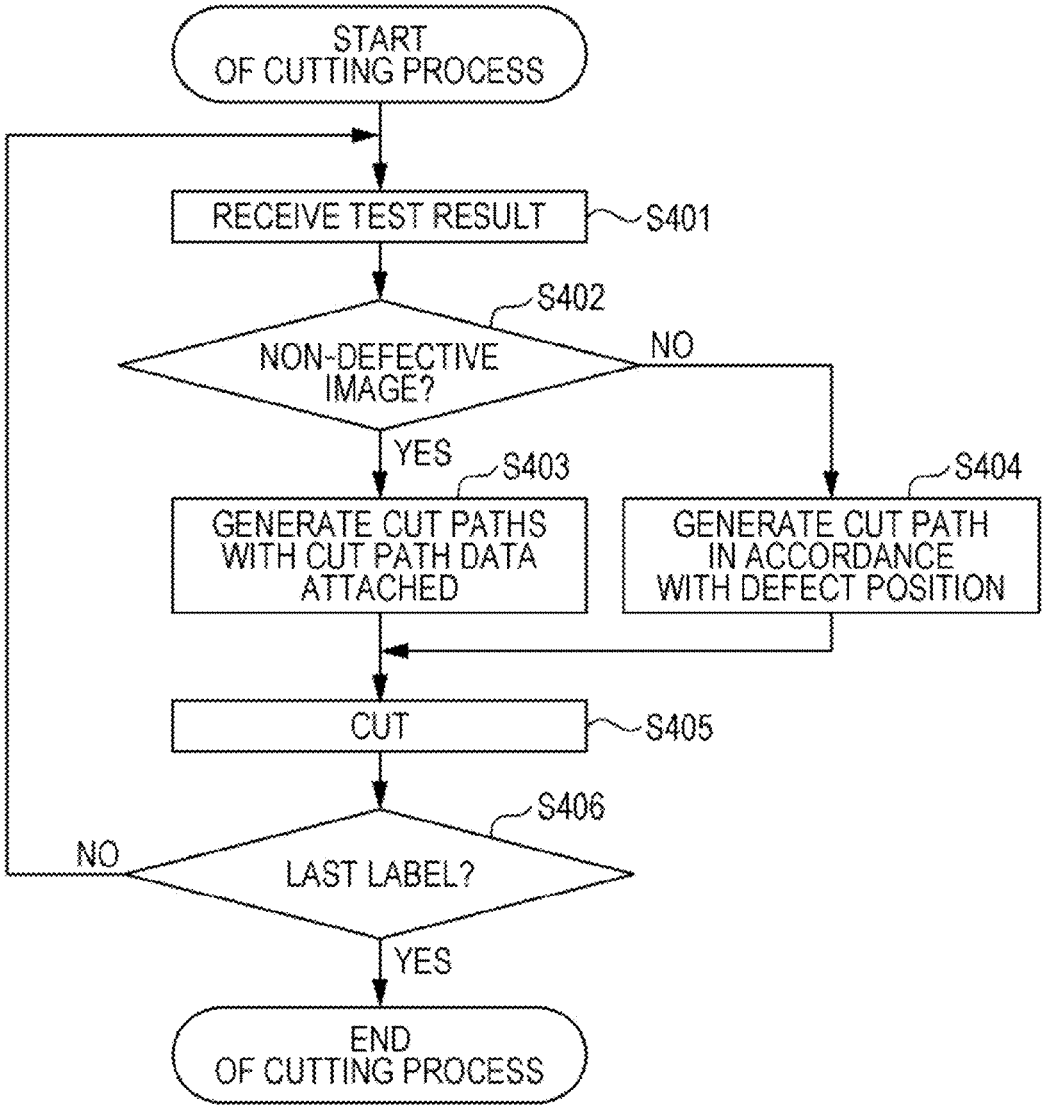
FIG. 14 is a flowchart for describing a cutting process of the embodiment.
Figures 15A, 15B, 15C:
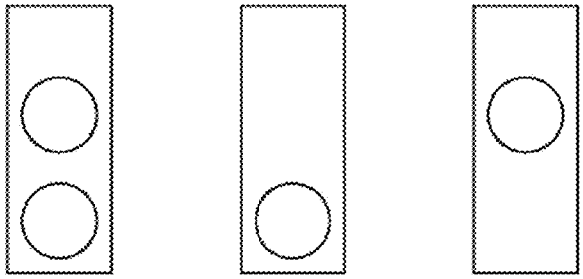
FIGS. 15A through 15C are descriptive diagrams of cut paths generated in the embodiment.

After the test process, a cutting process illustrated in FIG. 14 is carried out in this embodiment. FIG. 14 is a flowchart for describing the cutting process of this embodiment. Further, FIGS. 15A through 15C are descriptive diagrams of cut paths generated in this embodiment.

First, the controller 50 receives a test result from the test unit 20 (S401) and makes the cut path generator 31 generate cut path data in accordance with the test result. For example, if the test result indicates a non-defective image ("YES" at S402), the cut path generator 31 generates cut path data, as shown in FIG. 15A, in which the cut path data shown in FIG. 12 are arranged at two locations using the image attachment information (S403). Accordingly, as shown in FIG. 15A, the cut path data is made to correspond to the image data shown in FIG. 13.

On the other hand, if the test results indicates a defective image ("NO" at S402), the cut path generator 31 generates cut path data in accordance with a defect position (S404). For example, if a portion where the defect has been detected is included in a region of the upper stage, the cut path generator 31 generates cut path data in which the cut path data shown in FIG. 12 is arranged only in the lower stage (see FIG. 15B). Meanwhile, for example, if a position where the defect has been detected is included in a region of the lower stage, the cut path generator 31 generates cut path data in which the cut path data shown in FIG. 12 is arranged only in the upper stage (see FIG. 15C). If defects have been detected in both the upper and lower stages, any cut path data is not generated (drawing is omitted).

Subsequently, the controller 50 makes the laser cutter 33 irradiate the seal member 6 with a laser beam using the cut path data every time the eye mark sensor of the cutting section 32 detects an eye mark on the roll paper S. The seal member 6 is cut in this manner (S405).

Then, the controller 50 determines whether or not the current label is the last one (S406). If it is determined that the current label is not the last one ("NO" at S406), the process returns to step S401 to carry out the cutting process again. If it is determined that the current label is the last one ("YES" at S406), the cutting process is ended.

Figure 16:
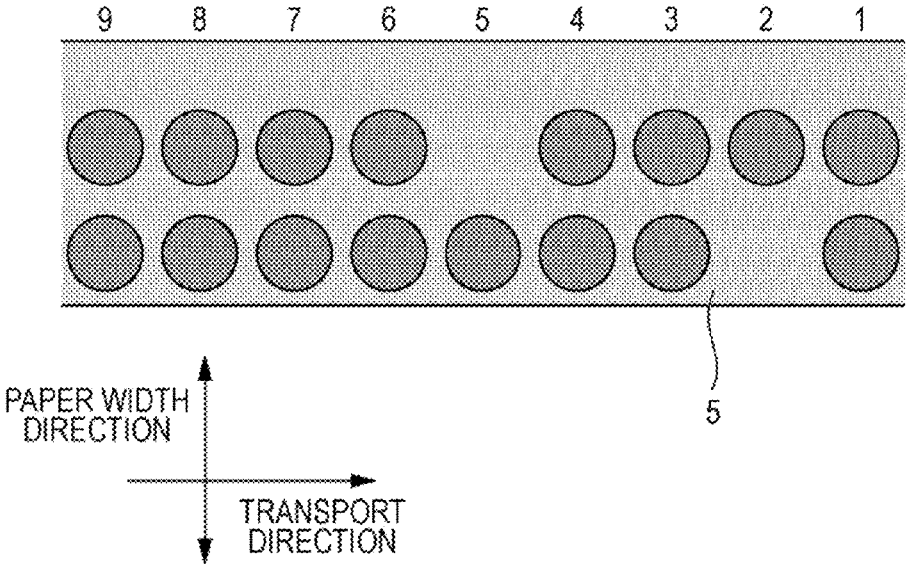
FIG. 16 is a diagram illustrating a state after operations of cutting and unused portion removal have been performed on the image shown in FIG. 10 in the embodiment.

FIG. 16 is a diagram illustrating a state after the cutting and the unused portion removal have been performed on the image shown in FIG. 10 in this embodiment.

For example, no defect is present in the print images of the first row in FIG. 10. Therefore, the cut paths shown in FIG. 15A are used so that a portion of the seal member 6 that includes a label image in the upper stage and a label image in the lower stage is cut. Through this, as shown in FIG. 16, both the label image in the upper stage and the label image in the lower stage are left on the mount 5 after the unused portion removal.

Further, in FIG. 10, of the print images of the second row, an image in the lower stage is defective. In this case, the cut path shown in FIG. 15C is used so that a portion of the seal member 6 that includes an image in the upper stage is cut. Through this, as shown in FIG. 16, the label image in the upper stage in the print images of the second row is left on the mount 5 after the unused portion removal.

Furthermore, in FIG. 10, of the print images of the fifth row, an image in the upper stage is defective. In this case, the cut path shown in FIG. 15B is used so that a portion of the seal member 6 that includes an image in the lower stage is cut. Through this, as shown in FIG. 16, the label image in the lower stage in the print images of the fifth row is left on the mount 5 after the unused portion removal. Note that the operator pastes non-defective label images later to the portions from which the defective images have been separated. In this embodiment, because the number of label images that are separated is smaller than that in the comparative example, it is possible to reduce the number of label images to be pasted in comparison with the comparative example.

As described above, in this embodiment (FIG. 16), the productivity of label images can be enhanced in comparison with the comparative example (FIG. 11).

As has been described thus far, the label production apparatus 1 of this embodiment includes: the printing section 13 configured to print a label image on the base material 3 of the roll paper S while using image data for generation of the label image; the test unit 20 configured to test the label image printed on the roll paper S; the memory 52 configured to store image attachment information that specifies image arrangement positions when two label images are arranged on the roll paper S; and the post-process unit 30 configured to cut a portion of the base material 3 where the label image has been formed. Further, the post-process unit 30 generates such a cut-line based on the image attachment information, if a print defect is detected by the test unit 20, that avoids cutting of the label image in which the print defect is detected among the plurality of label images so as to cut the base material 3 (seal member 6) using the generated cut-line.

Through this, also in the case where multiple label images are arranged and attached, it is possible to prevent only a label image in which a print defect is detected from being cut with certainty. In other words, the label image having the print defect can be removed with certainty as an unused portion. Accordingly, it is possible to enhance the productivity of label images.

3. Other Embodiment

The above embodiment is given so as to facilitate understanding of the invention, and is not intended to limit the interpretation of the invention. This invention can be modified or improved without departing from the spirit of the invention, and it is needless to say that those equivalent entities are included in this invention. In particular, an embodiment described hereinafter is also included in this invention.

Printing Section 13

In the above embodiment, although the printing section 13 is a line printer, the invention is not limited thereto. For example, such a printer may be employed as the printing section 13 that has a plurality of heads disposed facing a circumferential surface of a cylindrical transport drum and discharges ink from the heads toward a medium while transporting the medium along the circumferential surface of the transport drum so as to form an image on the medium. In addition, for example, the printing section 13 may be a printer (lateral printer) that repeats operation of discharging ink toward a medium that has been transported to a printing region while moving a head of the printer along a transport direction of the medium as well as operation of moving the head in a width direction of the medium so as to form an image in the printing region, thereafter transports a portion of the medium on which printing has not been performed to the printing region.

Discharge Technique

The technique of discharging ink from a head may be a technique that discharges ink using a piezoelectric element (piezo element) or a technique that discharges ink using bubbles generated by heat in a nozzle. Other techniques may be used as well.

Medium

Although, as an example of a medium, roll paper S is cited and described in the above embodiment, the invention is not limited thereto. It is sufficient that the medium is formed of three layers including the base material 3, the adhesive layer 4 and the mount 5. For example, the medium may be a cut paper. Further, the materials of the three layers are not limited to any specific ones. The base material 3 may be a film, for example.

Ink

As inks for color images, although the four color inks of cyan, magenta, yellow, and black are used in the above embodiment, other color inks (for example, light cyan, light magenta, and the like) may be additionally used.

A UV curing ink that hardens when being irradiated with ultraviolet light (UV) may be used. In this case, by providing a light source for emitting UV at the downstream side of each of the heads in a medium transport direction and irradiating a medium with the UV on which dots have been formed, the dots can be fixed on the medium. Accordingly, printing can be favorably performed even on a medium which is unlikely to absorb ink.

Label Image

Although a circular figure is printed as a label image in the above embodiment, the invention is not limited thereto. Other figures, pictures, symbols (characters), and the like may be printed. Further, in the above embodiment, although two label images are arranged in the paper width direction, the invention is not limited thereto. For example, three or more label images may be arranged being aligned (attached) in the paper width direction.

A single label image (unit image) may include a plurality of partial images. In other words, a plurality of label images each of which has a plurality of partial images may be attached and formed. Also in this case, it is sufficient that information specifying whether to cut or not is set by the image attachment information for each single region of the label image. For example, in the case where a label image including two partial images is arranged and attached, if a print defect is detected in one of the two partial images thereof, this label image including the defective partial image is determined to be defective. Through this, in the case where at least one of a plurality of partial images of a label image is defective, it is possible to remove the whole label image including the defective partial image as an unused portion. Through this, it is possible to prevent part of the plurality of partial images from remaining on the mount 5, which makes it possible for the operator to easily paste a non-defective image. Accordingly, the productivity of label images can be enhanced.

Image Attachment Information

Although image attachment information is inputted as part of a print job in the above embodiment, the invention is not limited thereto. For example, the operator may specify image attachment positions via an input device (not shown). Further, for example, printing may be performed using the image data shown in FIG. 6, then the controller 50 may check differences in images from a scanner image of a test result obtained by the test unit 20 so as to calculate the image attachment information as shown in FIG. 12 by finding out identical image regions. Through this, the image attachment information can be automatically obtained.

Test Unit 20

Although, in the above embodiment, the scanner 21 is used to test whether or not a label image is non-defective, the invention is not limited thereto. For example, such a technique may be employed that detects a defect portion (ink not being discharged) in real time by an electric signal of residual vibration of the head at a time of ink discharge.

Post-Process Unit 30

Although, in the above embodiment, the post-process unit 30 includes the cutting section 32 and the unused portion remover 35, the invention is not limited thereto. For example, the unused portion remover 35 may be provided as a separate device (different entity) and may only perform removing an unused portion of the roll paper S that has experienced the cutting.

The entire disclosure of Japanese Patent Application No. 2013-068289, filed Mar. 28, 2013 is expressly incorporated by reference herein.

What is claimed is:

1. A label production apparatus comprising:

a printing unit configured to print label images on a first base material included in a print target medium that has the first base material, a second base material, and an adhesive layer interposed between the first base material and the second base material while using image data for generation of the label image, wherein the printing unit prints an eye mark for the label images printed on the first base material;

a test unit configured to test the label images printed on the print target medium for defects, wherein a print defect, when found in one of the label images, is associated with a position;

a memory unit configured to store layout information that specifies image arrangement positions of the label images and of the eye mark arranged on the print target medium, wherein the eye marks and the label images are printed in accordance with the layout information of the eye marks and the label images; and a post-process unit that is configured to cut a portion of the first base material where the label images have been formed, and that is configured to generate a cut-line based on the layout information for each label image that is not associated with a print defect, wherein if the print defect is detected by the test unit, cutting of the label image in which the print defect is detected among the plurality of label images so as to cut the first base material using the generated cut-line is avoided for a label image corresponding with the position of the print defect, wherein the eye mark is used to control a timing when cutting is performed for the label image that does not include a defect.

2. The label production apparatus according to claim 1, wherein each of the label images is so configured as to include a plurality of partial images, and a certain label image is determined to be a defective print image if a print defect is detected by the test unit in at least one of the plurality of partial images of the certain label image.

3. The label production apparatus according to claim 1, wherein the layout information is used together with the image data when a plurality of the label images are printed in the printing unit.

4. The label production apparatus according to claim 1, wherein the layout information is calculated in accordance with a detection result of differences among the plurality of label images detected by the test unit.

5. A label production method comprising:

printing a label image on a first base material included in a print target medium that has the first base material, a second base material, and an adhesive layer interposed between the first base material and the second base material while using image data for generation of the label image;

printing an eye mark for the label image;

testing the label image printed on the print target medium for a print defect, wherein the print defect is associated with a position;

storing, in a memory unit, layout information that specifies image arrangement positions and eye marks when a plurality of the label images are arranged on the print target medium, wherein the eye marks and the plurality of the label images are printed in accordance with the layout information of the eye marks and the plurality of the label images; and post-processing that is configured to cut a portion of the first base material where the label image has been formed, and that is configured to generate a cut-line based on the layout information, wherein if a print defect is detected in the testing, cutting of the label image in which the print defect is detected among the plurality of label images so as to cut the first base material using the generated cut-line is avoided, wherein the label image for which cutting is avoided is based on the position of the defect.

6. A label production apparatus comprising:

a printing unit configured to print label images in rows on a first base material included in a print target medium that has the first base material, a second base material, and an adhesive layer interposed between the first base material and the second base material while using image data for generation of the label image, wherein an eye mark is printed for each row of the label images, wherein the eye mark is arranged in accordance with layout information and wherein each of the label images is in a different region relative to the eye mark;

a test unit configured to test each row of the label images for defects, wherein a print defect, when found in one of the label images, is associated with the region of the label image in which the print defect is found;

a cut path generator that generates cut path data in accordance with a position of any print defect found by the test unit, wherein cut path information is generated for each region that is not associated with the print defect and wherein cut path information is not generated for each region that is associated with the print defect;

a post-process unit that is configured to cut a portion of the first base material where the label images have been formed based on the cut path information, wherein the eye mark is used to control a timing when cutting is performed for the label image that does not include a defect.

* * * * *